United States Patent [19]

Long et al.

[11] Patent Number: 4,641,897

[45] Date of Patent: Feb. 10, 1987

[54] PORTABLE HANGING FILE AND DESK TOP DISPLAY FOR FLOPPY DISKS

[75] Inventors: Jerry M. Long, Pleasanton; James A. Womack, Los Gatos, both of Calif.

[73] Assignee: Innovative Concepts, Inc., San Jose, Calif.

[21] Appl. No.: 611,903

[22] Filed: May 18, 1984

[51] Int. Cl.[4] ..... A47B 63/00; B42F 17/00

[52] U.S. Cl. ..... 312/183; 312/185; 220/22.1; 220/22.5; 211/50; 211/126

[58] Field of Search ..... 312/183, 185, DIG. 33; 211/42, 50, 126; 220/22.1, 22.5; 206/425

[56] References Cited

U.S. PATENT DOCUMENTS

| | | | |
|---|---|---|---|
| 960,833 | 6/1910 | Crum | 220/22.1 |
| 1,695,257 | 12/1928 | Ohnstrand | 220/22.5 |
| 2,887,352 | 5/1959 | Ruddell | 312/183 |
| 3,334,635 | 8/1967 | Fleischhauer et al. | 220/22.5 |
| 3,556,621 | 1/1971 | Blakley | 312/183 |
| 3,640,421 | 2/1972 | Conway et al. | 220/22.5 |
| 3,817,393 | 6/1974 | Neilsen | 211/50 |
| 3,892,331 | 7/1975 | Beck | 312/DIG. 33 |
| 4,163,495 | 8/1979 | Drader | 211/126 |

FOREIGN PATENT DOCUMENTS

| | | | |
|---|---|---|---|
| 221067 | 5/1962 | Austria | 312/183 |
| 993297 | 7/1976 | Canada | 312/183 R |
| 2727692 | 11/1978 | Fed. Rep. of Germany | 312/183 |

*Primary Examiner*—Victor N. Sakran

*Attorney, Agent, or Firm*—Hamrick, Hoffman, Guillot & Kazubowski

[57] ABSTRACT

A storage and display device for floppy disks and the like including a molded base unit having a tray for supporting the disks on one edge thereof, a plurality of dividers for separating quantities of the disks within the tray, and hangers pivotally attached to each end of the base unit for suspending the storage container relative to a pair of parallel supports. The hangers are pivotable between a position in parallel side-by-side relationship with the corresponding end surface of the tray and a position extending upwardly relative to the end walls of the tray.

5 Claims, 10 Drawing Figures

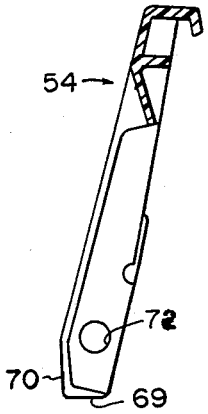
FIG. 6
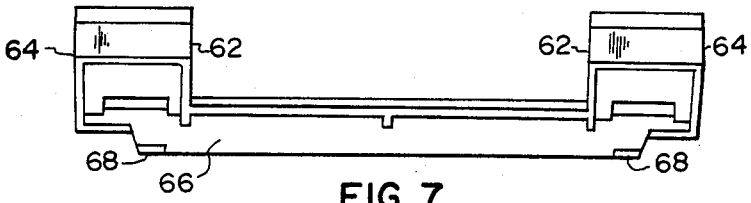
FIG. 7
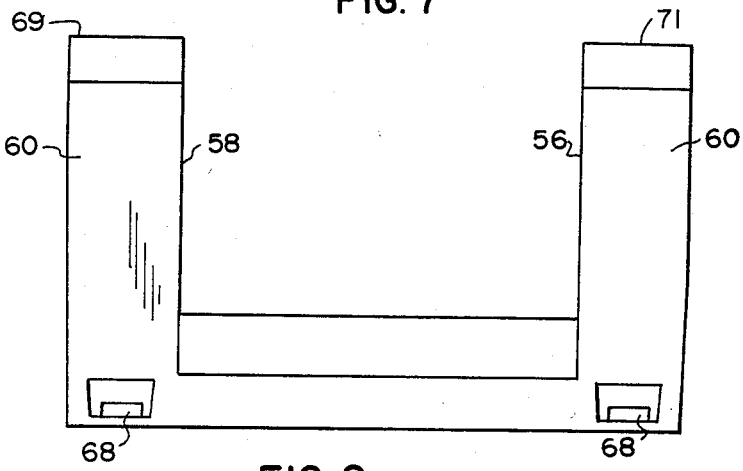
FIG. 8
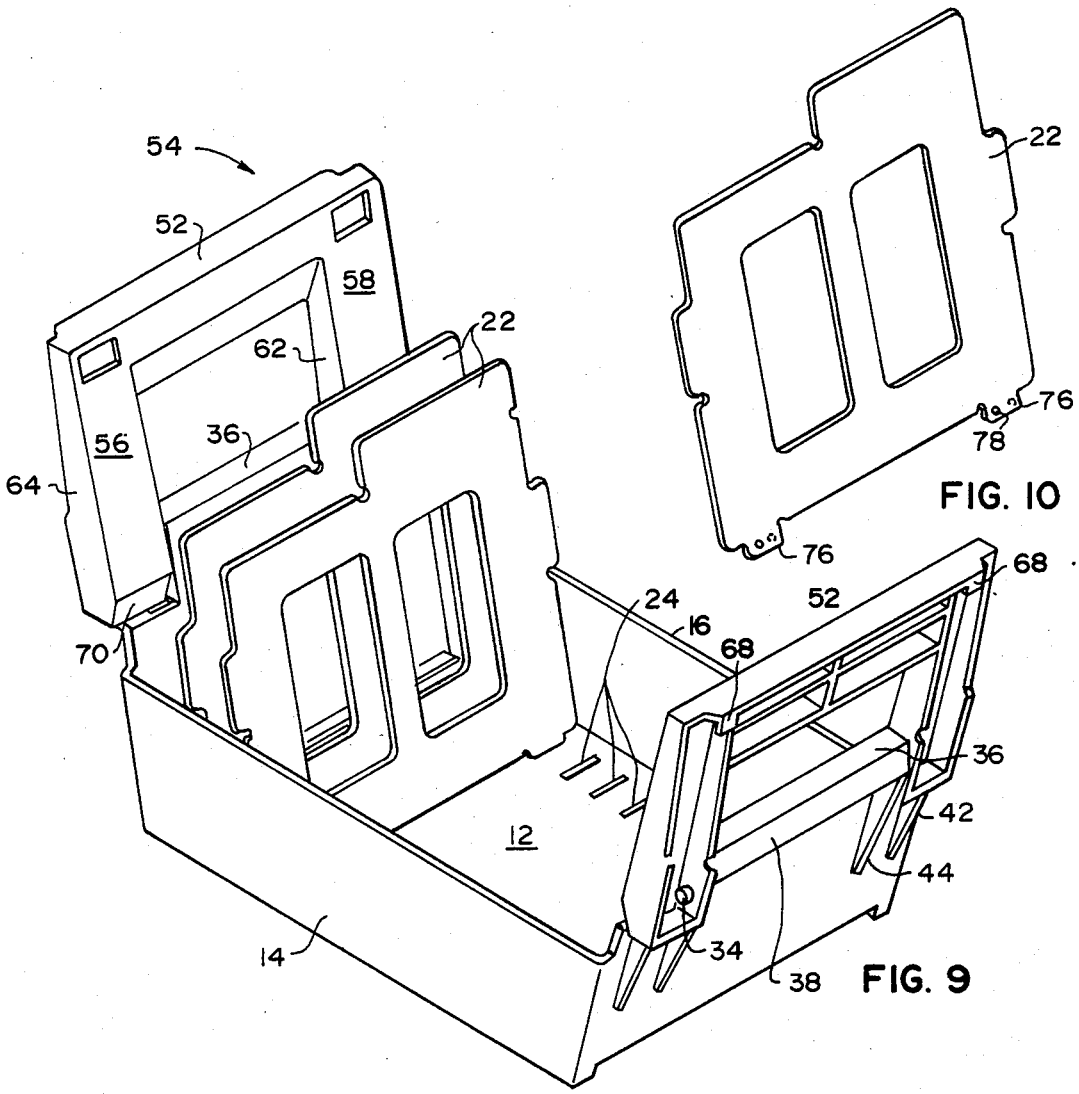
FIG. 10
FIG. 9

PORTABLE HANGING FILE AND DESK TOP DISPLAY FOR FLOPPY DISKS

BACKGROUND OF THE INVENTION

1. Field of the Invention

This invention relates to disk storage and display arrangements for filing and retrieval of substantially flat rectangular members such as floppy disks. In particular, the invention relates to an arrangement that is adapted to hanging on the rods used for file storage in a desk or filing cabinet and which is also adaptable for setting on a desk top.

2. Description of the Prior Art

Any number of desk top filing and storage containers suitable for filing floppy disks and the like are now commonly available. Although structural features of the storage containers disclosed in the prior art are often dissimilar, they all have one common attribute. This attribute is that they are designed to rest on a desk top when in use and for temporary storage or on a storage shelf when not in use. There are two problems associated with such storage containers. The first is that the storage area for the containers not in use may be some distance from the user which requires the time consuming problem of retrieval. Second, many of the storage containers in the prior art most normally have some form of cover device which requires extra desk space if the devices are open so that the diskettes are readily accessible.

SUMMARY OF THE PRESENT INVENTIO

It is therefore an object of the present invention to provide a storage container for disks and the like that can be placed on the file hanging rods in the file drawer of a desk.

It is another object of the present invention to provide a storage device of the type described which can be readily manufactured using injection molding techniques.

Another object of the present inventio is to provide a storage container of the type described having means for separating and identifying the various media envelopes filed therein.

It is a further object of the invention to provide a storage container which is compact and which can be adapted to set on a desk top when in use.

Briefly, a preferred embodiment of the present invention includes a molded base unit including a tray for supporting said disks on one end thereof; divider means for separating predetermined numbers of said disks in said tray and means for suspending said storage means.

IN THE DRAWING

FIG. 6 is a section view along the line 6—6 of FIG. 5;

FIG. 7 is an end view of one said hanging handle;

FIG. 8 is a plan view of the top of said hanging handle (54);

FIG. 9 is a perspective view of the storage container showing a number of separator elements (22) installed and the hanging handles in the raised (hanging) position; and FIG. 10 is a perspective view of one said separator element (22).

DETAILED DESCRIPTION OF THE PREFERRED EMBODIMENT

Figure 1:
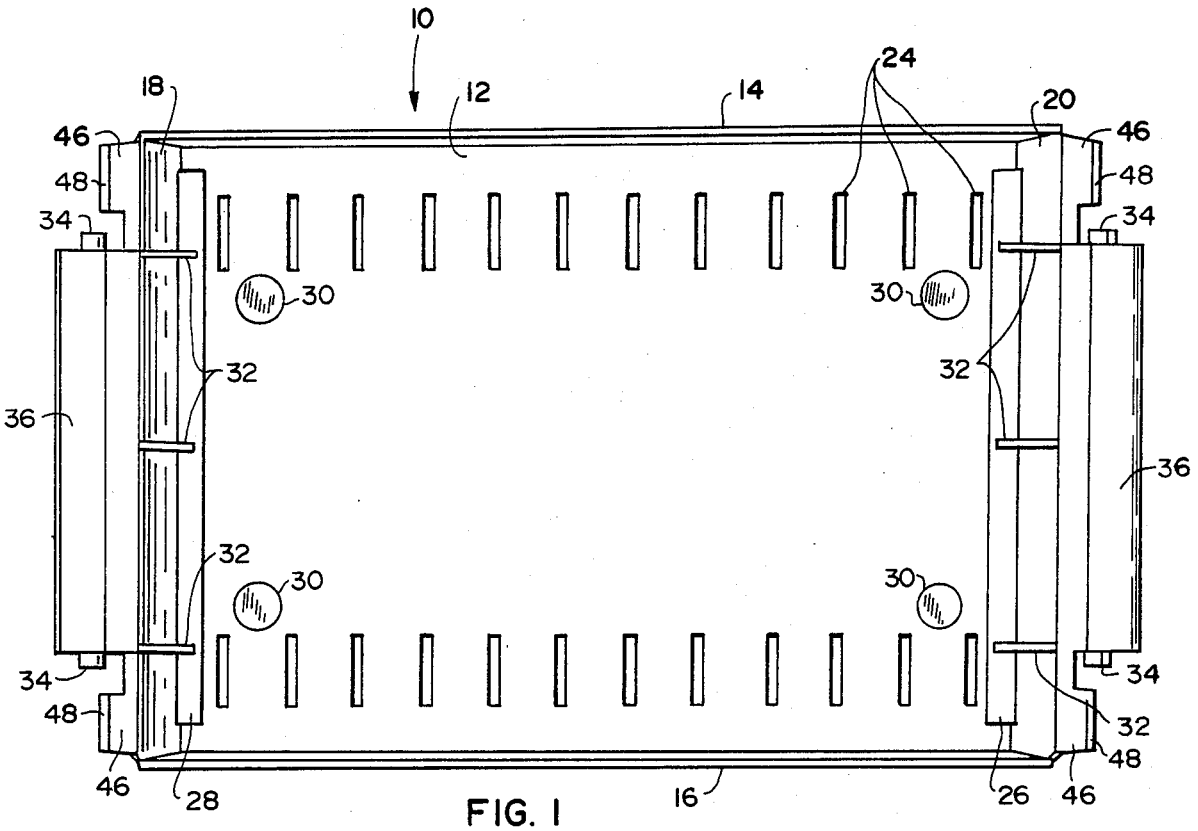
FIG. 1 is a top view of a hanging disk file with the hanging handle (54) removed.
Figure 2:
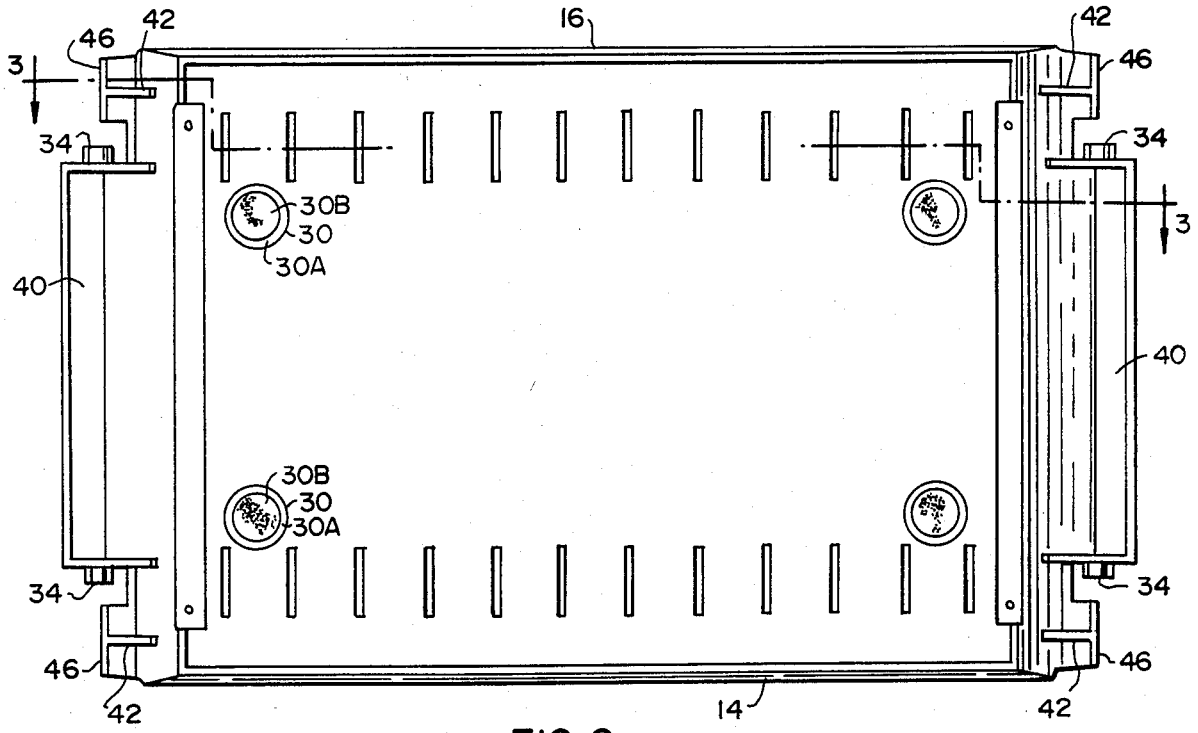
FIG. 2 is a bottom view of said hanging disk file.
Figure 3:
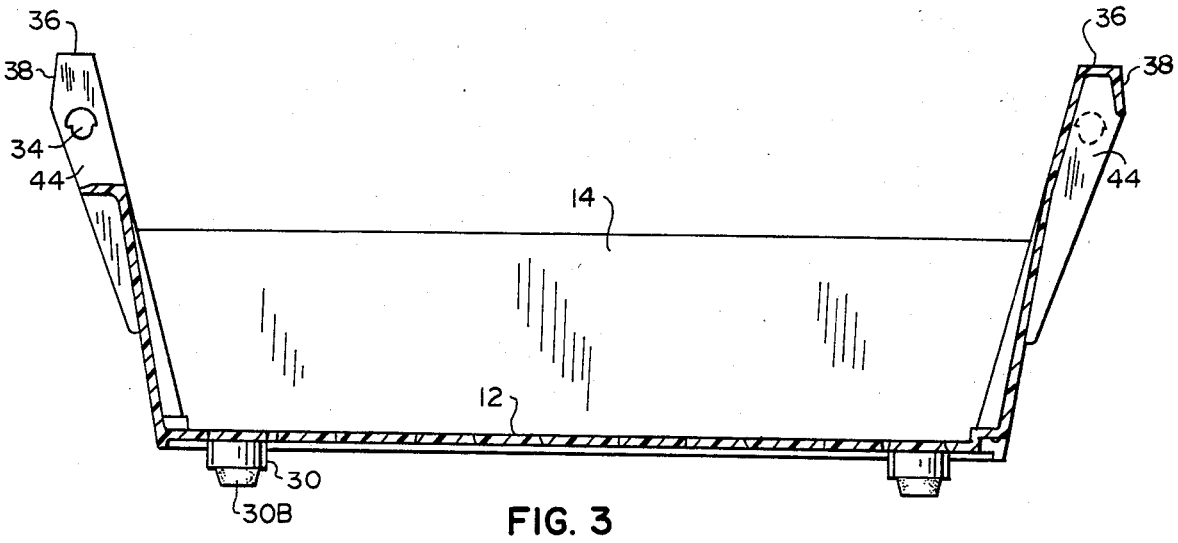
FIG. 3 is a sectional view along the line 3—3 of FIG. 1.
Figure 4:
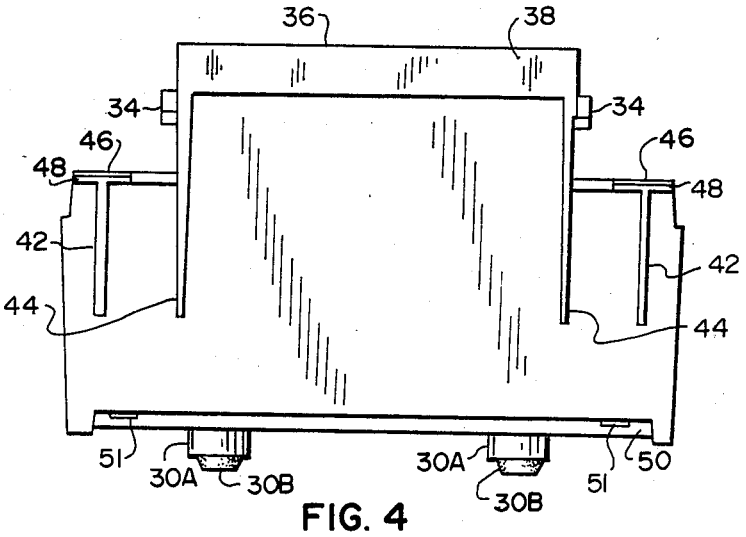
FIG. 4 is an end view illustrating the pintles (34) to which a hanging handle (54) may be pivotally attached.
Figure 5:
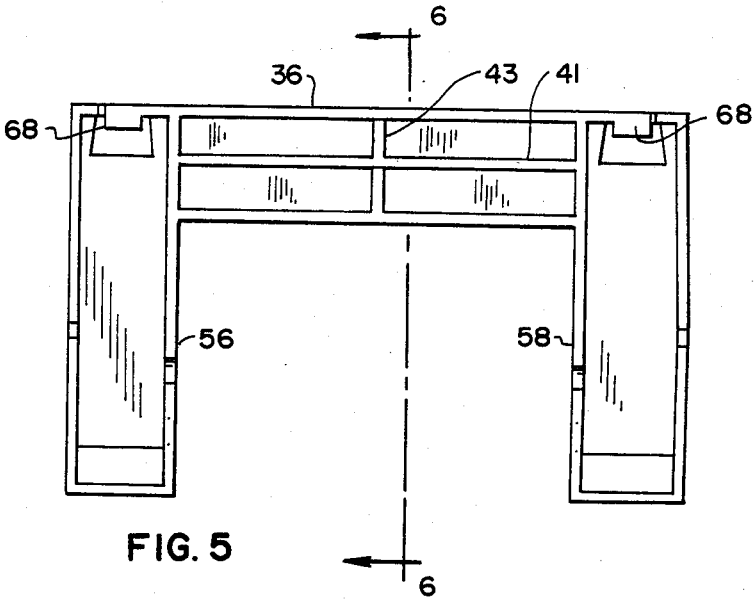
FIG. 5 is a plan view of the inside of hanging handle (54)

Referring now to FIG. 1 in which a top view of the storage container is illustrated, it may be seen that a tray 10 has a rectangular floor surface 12 from which upright side walls 14 and 16 extend. the tray is closed by outwardly inclined end walls 18 and 20 that are formed with the side walls to form a open top box-like construction. The end walls are inclined outwardly in order to permit the tilting of the diskettes stored therein and thus facilitate the selection and removal of a particular diskette. The height of the end walls also is related to the length of the hanger handles 54. Raised members 51 are positioned toward the outward portion of recess 50 so as to permit latching engagement with tabs 68 as hanging handle 54. Thus, the hanger handles 54 are latched to the end walls so that they are out of the way when the tray is sitting on a desk. The upright side walls 14 and 16 are of sufficient height to prevent the inadvertent tipping out (transverse movement) of a disk while the portable storage container is being moved. The height is also related to the incline of each of the separator elements 22 as will be discussed in more detail subsequently.

A plurality of guide slots such as shown at 24 are positioned in equally spaced increments adjacent each of the upright side walls 14 and 16 as shown in FIG. 1. Adjacent the base of each end wall is a raised platform as shown at 26 and 28. These platforms provide a footing at each end against which an edge of an adjacent disk may rest, and the platforms prevent undesired location of the disk between an end wall and an adjacent divider. The interior has molded therein four circular depressions 30 which extend through the bottom surface of the floor 12.

Referring again to the end walls 18 and 20, it may be seen that stiffener bars 32 are provided on the interior thereof. Referring now to FIGS. 1–4, it may be seen that pintles 34 are formed on the out board side of support members 44. As will become clear later, thse pintles 34 are used to pivotally connect the hanging handles 54 to the tray 10. The depressions 30 are formed so that there is an interior depression on the bottom side thereof that is adpated to frictionally hold well known rubber or plastic feet 30B, which will prevent slipping on a desk or other surface.

Once the hanging disk tray has been removed from the hanging rods, it is desirable to provide a finger grip area to facilitate movement. This is accomplished by a substantially horizontal outboard wall extension 36 which is formed along the top edge of each end wall. A downward extension 38 for each of the end walls combines with outboard extension 36 to provide finger aperture 40. It is to be noted that in a prefered embodiment of the invention, the finger grip is formed as a part of a naorrowed upward extension of the end wall.

It is to be noted that two pairs of stiffener bars 42 and 44 are provided. Stiffener bars 42 provide support for the latching tabs 46, and extend downward thereform.

Bars 42 are near the sidewalls, and tabs 46 are raised slightly above the height of the widest part. This permits latching engagement with the terminal ends 69 and 71 of fingers 56 and 58, respectively, when the hanger handles 54 are in the raised condition. It should be noted that latching tabs 46 are arranged to have a beveled surface 48 which facilitates closure when the hanging handles are to be latched against the end walls.

Stiffener bars 44 provide support for the finger grip. The interior flat surface closes the ends of the finger grip. On the exterior flat surface, a pintle 34 is formed adjacent the bottom edge of downward extension 38. At the lower end of end wall 18 is arecess 50 which is designed to accept the hanger portion 52 of the hanging handle 54. The elements of the hanging handle 54 may be clearly seen in FIGS. 5–8. Each hanging handle 54 includes a pair of fingers 56 and 58 each of which have an exterior surface 60, an interior side wall 62 and an exterior side wall 64. The tope dge of the exterior surface 60 of each said finger has a camber or bevel 70. On the interior wall 62 of each finger is an aperture 72 near the lower part of the bevel portion of the exterior wall 60. The apertures 72 are designed to accept the pintles 34 for pivotal attachment of the hanging handle 54 to the end walls of the tray 10.

When hanging the tray on the file rods of a filing cabinet or a file drawer of a desk, the handles are tilted upward as shown in FIG. 9. The hanger tabs 68 are positioned on one side of a hanger rod and the main body of the hanger handle is on the other side of said rod. Thus, the hanger handle is secured thereto and support for the tray 10 is provided by the hanger surface 66, i.e., the channel formed between the tabs and the main body of said hanger along surface 66. When the tray is to be removed from the file drawer, the tray may be picked up by inserting the fingers in finger apertures 40 and lifting the tray out therefrom. The handles then can pivot downward and the tabs 68 now engage the recess 50 at the bottom edge of an associated end wall. This engagement of said hanging tabs 68 with the recess 50 holds each handing handle 54 against the exterior side of its respective end wall.

In order to provide adequate separation of a plurality of diskettes, separators 22 are inserted in selected ones of the guide slots 24 which are formed in the floor surface 12 of tray 10. Referring now to FIG. 10, a perspective view of a separator element 22 may be seen. Note that there are a pair of end tabs 76 which are designed to extend into guide slots 24 and each end tab has oppositely disposed detent projections 78 which hold the separator elements in the selected guide slots. The detent projections 78 are of sufficient substance to prevent the separator elements 22 from falling out when the tray 10 is tipped. But the detent projections 78 are not so large as to prvent removal of a separator element when it is desired to either take it out or to place it in a different position.

A perspective view of the tray 10 with the hanger arms raised so as to be ready for positioning in a file drawer is shown in FIG. 9. It may be seen that the hanger arms may be swung through an arc of substantially 180 degrees.

While this invention has been described in the light of a preferred embodiment thereof, it is contemplated that modifications will become apparent to those skilled in the art after having read the preceding description of the preferred embodiment. It is therefore intended that the following appended claims be interpreted as covering all such modifications as fall within the tru spirit and scope of this invention.

What is claimed is:

1. A storage and display device for substantially flat, rectangular elements such as floppy disks and the like, comprising:

tray means for supporting said elements on an edge thereof and including a bottom, a pair of oppositely disposed end walls which incline outwardly and extend upwardly a predetermined distance from the bottom of said tray, and a pair of sidewalls extending upwardly from said bottom a second predetermined distance which is less than said first predetermined distance;

separator means for separating quantities of said elements stored in said tray;

aligment means formed in said bottom for positioing said separator means;

means for suspending said tray beneath a pair of parallel extending supports and including a pair of hanger means each having one end adapted for attachment to one of said supports and another end pivotally attached to an upper portion of one of said end walls, said hanger means being configured such that they are rotatable between a first position lying substantially parallel to and coextensive with said end walls, and a second position wherein said one ends are located substantially higher than the upper extremeties of said end walls, said hanger means includes: a first portion having an inclined surface extending a full width of said first portion; a pair of finger member extending parallel to each other and away from said inclined surface, each said finger member having a terminal end and a flat face portion extending over most of its length, and inner and outer side walls that intersect said inclined surface; an aperture formed in each said inner side wall for accomodating pivotal attachment with said pintels; and a pair of tabs formed along an edge of said inclined surface and spaced from the edges of said inner and outer side walls to form a channel with said hanger may be mounted to a rod or similar support.

2. A storage and display device as set forth in claim 1 wherein each said end wall includes:

grip means for use in transporting said tray means, said grip means being formed in the upper portion of each said end wall;

stiffener means for strengthening said grip means and including at least one side member haivng a flat surface lying in a plane parallel with said side walls; and connector means formed on said flat surface for attaching said hanger means to said end wall.

3. A storage and display device as set forth in claim 2 wherein said connector means is a pintle extending outwardly from said flat surface.

4. A storage and display device as set forth in claim 1 wherein said separator means includes:

a plurality of generally planer members each of a generally rectangular shape and sized to have a width adapted to fit within said side walls, and each including tab means adapted for interconnection with said alignment means, whereby adjacent separator means may be positioned predetermined distances apart.

5. A storage and display device as set forth in claim 1 wherein each said end wall includes:

a recess extending along the bottom of said end wall throughout a major portion of the width thereof; and latching means formed in said recess for engagement with said tabs of said hanger means so as to hold said hanger means adjacent said end wall when said storage and display device is resting on a desk top or similar surface.

* * * * *